US005476053A

United States Patent [19]

Brocklehurst

[11] Patent Number: 5,476,053

[45] Date of Patent: Dec. 19, 1995

[54] FLAT SHEET HEMMING METHOD AND FOLDING AND SEPARATING APPARATUS

[75] Inventor: Charles E. Brocklehurst, Fountain Inn, S.C.

[73] Assignee: Sew Simple Systems, Inc., Fountain Inn, S.C.

[21] Appl. No.: 313,352

[22] Filed: Sep. 27, 1994

[51] Int. Cl.[6] ..... D05B 35/02

[52] U.S. Cl. ..... 112/475.06; 112/141; 112/147; 112/153

[58] Field of Search ..... 112/141, 136, 112/147, 153, 2.1, 10, 262.3, 475.06; 271/2, 13, 34; 226/88, 197, 198, 199; 270/32, 37

[56] References Cited

U.S. PATENT DOCUMENTS

| | | | |
|---|---|---|---|
| 1,826,677 | 10/1931 | Sailer | 112/141 |
| 2,419,068 | 4/1947 | Gensheimer | 112/141 |
| 2,694,372 | 11/1954 | Hadfield | 112/2 |
| 2,900,934 | 8/1959 | Judelson | 112/63 |
| 3,345,965 | 10/1967 | Gore | 112/10 X |
| 3,783,805 | 1/1974 | Guichard | 112/2 |
| 3,906,878 | 9/1975 | Burton | 112/423 |
| 4,068,603 | 1/1978 | Arbter | 112/121 |
| 4,154,180 | 5/1979 | Burton | 112/262.3 |
| 4,214,541 | 7/1980 | Zeigler, Jr. et al. | 112/262.3 |
| 4,269,130 | 5/1981 | Burton et al. | 112/262.3 |
| 4,462,322 | 7/1984 | Brocklehurst | 112/141 |
| 4,499,834 | 2/1985 | Ruestschle et al. | 112/2 |
| 4,570,557 | 2/1986 | Freermann | 112/147 |
| 4,594,956 | 6/1986 | Vartoukian et al. | 112/262.1 |
| 4,648,336 | 3/1987 | Ragnebring | 112/148 |
| 4,742,788 | 5/1988 | Dugan | 112/262 |
| 4,773,341 | 9/1988 | Brocklehurst | 112/121 |
| 4,856,442 | 8/1989 | Brocklehurst | 112/147 |
| 4,856,444 | 8/1989 | Brocklehurst | 112/262 |
| 4,932,344 | 6/1990 | Tatum | 112/262 |
| 5,133,273 | 7/1992 | Brocklehurst | 112/147 X |
| 5,173,976 | 12/1992 | Jubinville | 5/497 |

FOREIGN PATENT DOCUMENTS 2133052 1/1984 United Kingdom .

*Primary Examiner*—C. D. Crowder
*Assistant Examiner*—Ismael Izaguirre
*Attorney, Agent, or Firm*—Hopkins & Thomas

[57] ABSTRACT

The edge portion (18) of sheet material moves about a turning plate (65), moving through first and second right angle turns (44) and (45). A turning belt (50) moves in unison with the edge portion (18) through the first two turns, and then moves through third and fourth right angle turns to advance along its return flight. An open ended slot (73) is formed between the first and second right angle turns to allow the turning belt and edge portion to move from beneath the turning plate to above the turning plate, so as to permit the edge portion of the sheet material to always turn in a downward direction as it is being turned over and placed in a folded position. Folding plate (77) guides the sheet material to help form the fold (20) in the sheet material, and separator plate (76) separates the edge portion (18) of the sheet material from the turning belt (50).

18 Claims, 5 Drawing Sheets

FLAT SHEET HEMMING METHOD AND FOLDING AND SEPARATING APPARATUS

FIELD OF THE INVENTION

The invention disclosed herein generally relates to a system of forming sheet segments with folded hems at opposite edges, such as bed sheets having a foot hem and a head hem, with selvage forming the side edges of the segment of sheet material. More particularly, the invention relates to the process and apparatus for automatically and continuously forming the foot and head hems of the segments of sheet material prior to sewing through the folded hems.

BACKGROUND OF THE INVENTION

Bed sheets that are applied to mattresses typically include a bottom sheet and a top sheet. While the bottom sheet might be a "fitted" sheet in that it is formed to surround the sides and ends of the mattress as described in my U.S. Pat. No. 4,773,341, the top sheet typically is flat, having folded hems formed at the foot and head of the sheet, and selvage at the side edges of the sheet. During the production of the flat sheets, a long length of the sheet material must be handled during the hem folding and sewing function. While a static folder can be employed to form such long and typically wide folds of the sheet material, the longer the sheet material and the more flimsy the sheet material, the more difficult it is to accurately control the fold. One of the more expensive aspects of the fabrication of sheets is the manual handling of the bed sheet as it is sewn by the operator through a sewing machine. The operator must manipulate the large segments of sheet material when performing the sewing functions. Therefore, it is highly desirable to perform the turning and sewing of hems in a continuous and automated system, if possible.

SUMMARY OF THE INVENTION

Briefly described, the present invention comprises an automated system for continually forming bed sheets from a supply of sheet material, whereby the sheet material is advanced along its length from a supply to a cutting station and cut to length so as to form cut segments of sheet material. The cut segments of sheet material are then advanced in a processing path parallel to their cut edges, and their cut edges later become the head and foot edges of the finished bed sheet, or the side edges thereof, depending on how the system is set up. For the purpose of describing this invention, the cut edges will be considered as the head and foot edges.

The cut segments are first advanced through an accumulator whereby the cut segments are rapidly advanced out of the way of the oncoming supply of sheet material, and the cut segments are then progressively advanced from the accumulator first through a folding station, and then through a sewing station or other work station.

At the folding station, the cut head and foot edge portions and their adjacent body portions are each placed on a pair of belts, including an edge carrying surface conveyor belt and a body carrying surface conveyor belt which move along parallel processing paths toward a folding station. The opposite edge portions and their adjacent body portions of the segment of sheet material are moved in unison with the surface conveyor belts, and the edge carrying surface conveyor belts and their respective edge portions of the flexible sheet material are turned through right angle turns so as to turn the edge portion of the sheet material into overlying relationship with respect to the adjacent body portion of the sheet material. Once the edge portions of the sheet material have made two right angle turns and are in overlying folded relationship with respect to the adjacent body portions of the sheet material, the edge carrying surface conveyor belts move through two more right angle turns so as to advance away from the sheet material and then through the return flight of the belt.

The now folded foot and head edge portions of the flexible sheet material move in unison with and in overlying relationship with respect to the adjacent body portions of the segment of sheet material through the work station, where the now folded hem is sewn or otherwise attached to the body of the sheet material.

In order to guide the edge portion and adjacent body portion at each side of the sheet material, as well as to guide the edge carrying surface conveyor belt and its adjacent body carrying surface conveyor belt, a turning plate is used. The turning plate is a substantially flat plate which includes four angled turning edges about which the edge carrying surface conveyor belt turns, and an open ended slot through which the belt and the edge portion of the sheet material pass. The edge carrying surface conveyor belt, also known as the turning belt, must first ride on top of the sheet material, and then when passing about the first right angle turn, it turns the edge portion of the sheet material downwardly and through a right angle turn so as to advance the sheet material inwardly into overlying relationship with respect to the adjacent body portion of the sheet material. When advancing through the second right angle turn, the sheet material again must be turned downwardly and then back into the forward direction of movement of the segment of sheet material. In order to perform two downwardly directed right angle turns in sequence, the edge portion of the sheet material and its turning belt must pass through the open ended slot of the turning plate.

Once the turning belt has moved about the second right angle turn, the edge portion of the sheet material will be properly located in its folded over position onto the adjacent body portion of the sheet material. It is only necessary then to separate the turning belt from the sheet material.

A fold plate is positioned in the path of the sheet material and is adapted to have the edge portion of the sheet material folded over and onto its surface as the adjacent body portion of the sheet material moves therebeneath. The longitudinal edge of the fold plate establishes the position of the fold formed in the material.

In the meantime, a separator plate extends across the path of the sheet material, between the edge portion of the sheet material and the turning belt, so as to mechanically deflect the oncoming leading edge of the edge portion of the sheet material away from the turning belt, requiring the edge portion of the sheet material to remain in its folded over relationship and move in unison with respect to the adjacent body portion of the sheet material.

In a preferred embodiment of the invention, the fold plate defines an opening therein, and the separator plate is sized and shaped to fit in the opening of the fold plate. This allows the two plates to occupy the vertical space of only a single plate, so as to reduce the friction applied by these plates to the moving sheet material, and to permit the edge portion of the sheet material to travel the shortest possible distance during the folding operation.

The edge of the separator plate which faces the oncoming sheet material is angled across the direction of movement in a configuration that assures the separation of the fold belt and the edge portion of the sheet material.

Thus, it is an object of this invention to provide an improved method and apparatus for continually and automatically forming folded and sewn hems in the head and foot edges of flat bed sheets.

Another object of this invention is to provide an improved method and apparatus for continually and automatically forming head and foot hems in bed sheets from a supply of sheet material, whereby the supply of sheet material is cut into segments and the segments are continuously and automatically processed until the cut edges are formed into folded over hems at the head and foot of a bed sheet and sewn closed.

Another object of this invention is to provide a continuously operating, automated folding system for forming hems in flexible sheet material, such as flat bed sheets, which progressively folds the side edges of the segments into accurately aligned overlying relationship with respect to an adjacent body portion of the segments, substantially without wrinkling or deforming the folded portion prior to sewing the hem closed.

Another object of the invention is to provide a fold forming means and a separator means for accurately forming the fold of a hem in sheet material and for reliably separating the turning belt from the folded hem after the hem has been formed.

Another object of this invention is to provide a flat sheet hemmer that is reliable in operation, inexpensive to construct and to maintain and to operate, and which accurately and rapidly forms the hems in the head and foot of a segment of bed sheet material with a minimum of operator attention.

Other objects, features and advantages of this invention will become apparent upon reading the following specifications, when taken in conjunction with the accompanying drawings.

DETAILED DESCRIPTION

Figures 1, 3:
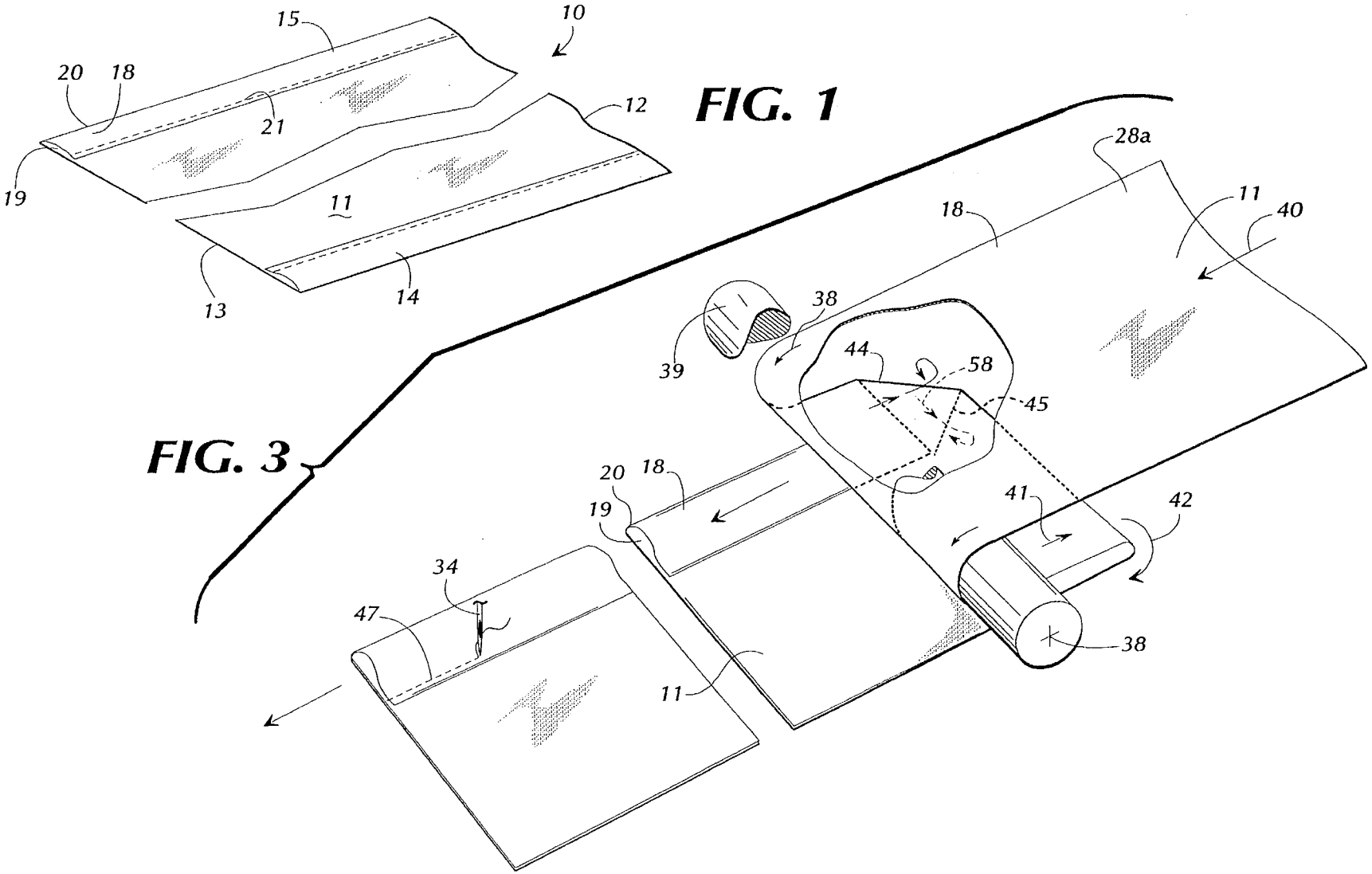
FIG. 1 is a perspective illustration of a portion of a flat bed sheet having foot and head hems sewn to the adjacent body portions thereof, with parts of the sheet broken away to reduce the size of the drawing figure.
FIG. 3 is a perspective illustration, with parts broken away, of one side of a segment of sheet material, showing how the head hem is formed.

Referring now in more detail to the drawings, in which like numerals indicate like parts throughout the several views, FIG. 1 illustrates a finished segment of sheet material, such as a flat top bed sheet of the type to be placed on a mattress of a bed. Typically, the bed would further include a bottom fitted sheet, with the flat top sheet 10 spread over the fitted sheet. The bed sheet 10 includes a main body portion 11, side edges 12 and 13, and foot and head edges 14 and 15. Typically, side edges 12 and 13 are formed by the selvage of the sheet material, whereas foot edge and head edges are formed with folded over hems that are sewn in their folded configuration. For example, the head 15 of the sheet 10 has a hem formed by the edge portion 18 and the adjacent body portion 19 with a fold 20 formed therebetween, and with stitching 21 fastening the edge portion to the adjacent body portion. Foot 14 is formed in a similar manner, but usually with a smaller hem.

Figure 2:
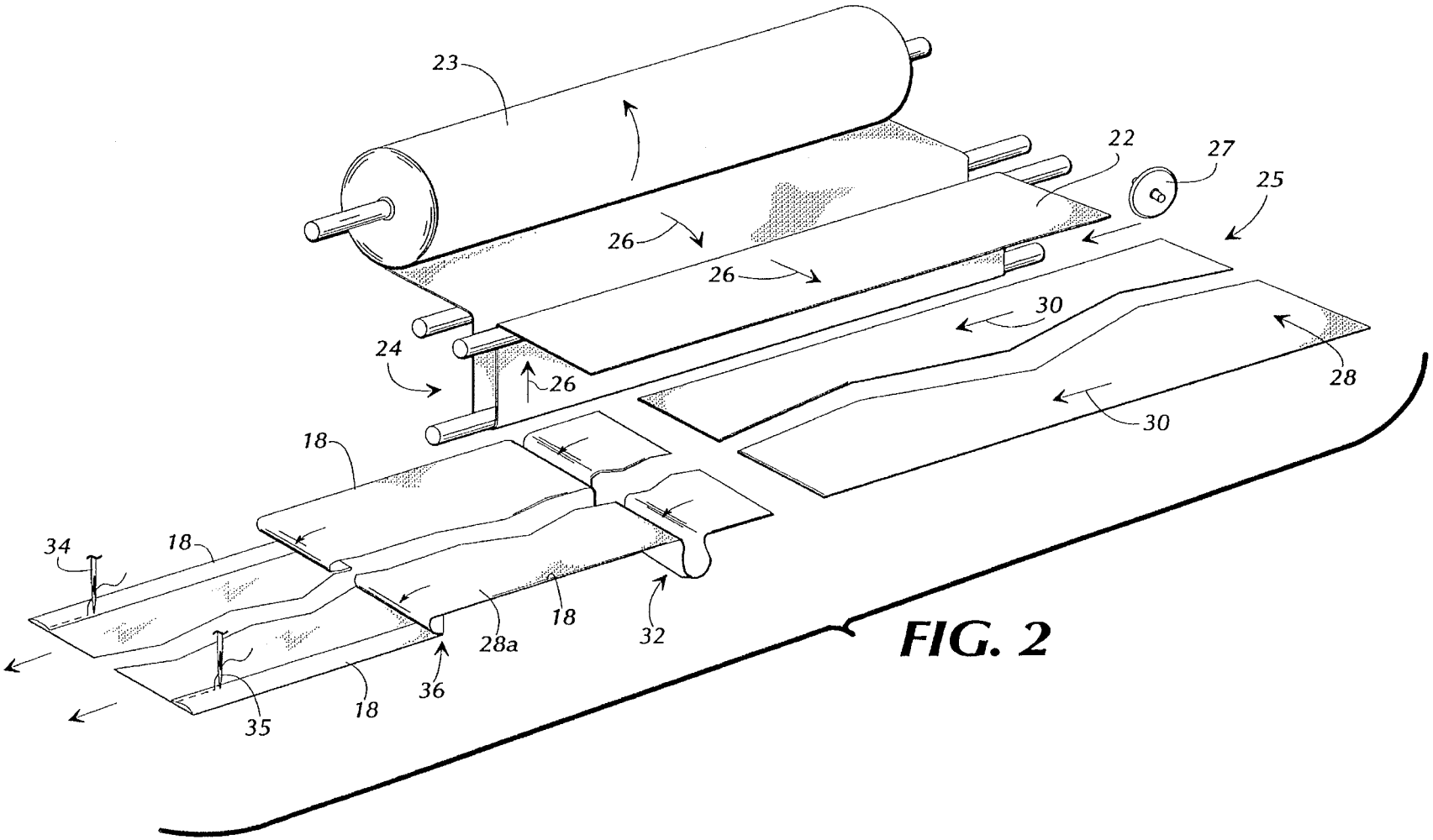
FIG. 2 is a perspective schematic illustration of the bed sheet material, illustrating the bed sheet material being paid out from a continuous supply, cut to length, and having the cut edges folded over to form the head and foot hems.

As illustrated in FIG. 2, the flat bed sheet 10 is formed by paying out sheet material from a continuous supply 23 through an accumulator 24, to a cutting station 25 in the directions as indicated by arrows 26. Once the leading portion of the sheet material has reached the cutting station 25, a sheet cutter 27 moves laterally across the sheet material 22 to cut the segment 28 of sheet material from its supply. The segment 28 will become the flat sheet 10 of FIG. 1.

After the segment 28 has been cut, the segment is advanced in the directions as indicated by arrows 30 to an accumulation station 32. The movement into the accumulation station 32 is rapid so as to remove the segment 28 from the next oncoming supply of sheet material 22. The functions of paying out, accumulating at the accumulator 24, cutting at the cutting station 25, and accumulating at the accumulation station 32 are similar to the steps described and illustrated in my U.S. Pat. No. 4,773,341.

The segment **28*a* of sheet material that is moved out of accumulation station 32 is moved at a slower rate which is compatible with the sewing machines 34 and 35** which are positioned on opposite sides of the processing path.

While FIGS. 1 and 2 of the drawing show both edge portions of the flat sheet (FIG. 1) and both edge portions of the segment 28 of sheet material as the segment is cut and folded and sewn (FIG. 2), the subsequent figures, FIGS. 3–9, show only one edge portion of the sheet material. It should be understood that the other edge portion of the segment of sheet material and the other side of the equipment used to form the other edge portion into a hem, are mirror images of the edge portion and equipment shown in FIGS. 3–9.

FIG. 3 illustrates the right hand side of a sheet segment **28*a*, with the center portion removed so that the folding process can be better illustrated. The entire segment 28*a* is moved through a reverse turn 38 about a guide roll 39, to change the direction of advancement of the segment from a forward direction 40 to a reverse direction 41. The main body portion 11 is then advanced through a second reverse turn 42. In the meantime, the edge portion 18 moves through two right angle turns 44 and 45, so as to turn the edge portion 18 first through a 45° angle inwardly and downwardly between the flights of the main body portion 11, and then to turn the edge portion a second time downwardly about a 45° angle. The first right angle turn advances the edge portion 18** inwardly into overlying relationship with respect to the adjacent body portion 19, and the second right angle turn aligns the edge portion 18 with the adjacent body portion 19 in a folded over relationship. The fold 20 separates the edge portion 18 and the adjacent body portion 19.

After the edge portion 18 has been turned into overlying folded relationship with respect to the adjacent body portion 19, the segment is advanced to the sewing machine 34. Segment **28*b* illustrates the sewing machine 34 sewing through and forming the stitches 47 through the edge portion 18 and adjacent body portion 19** of the hem. This completes the formation of the hem.

Figures 4, 5:
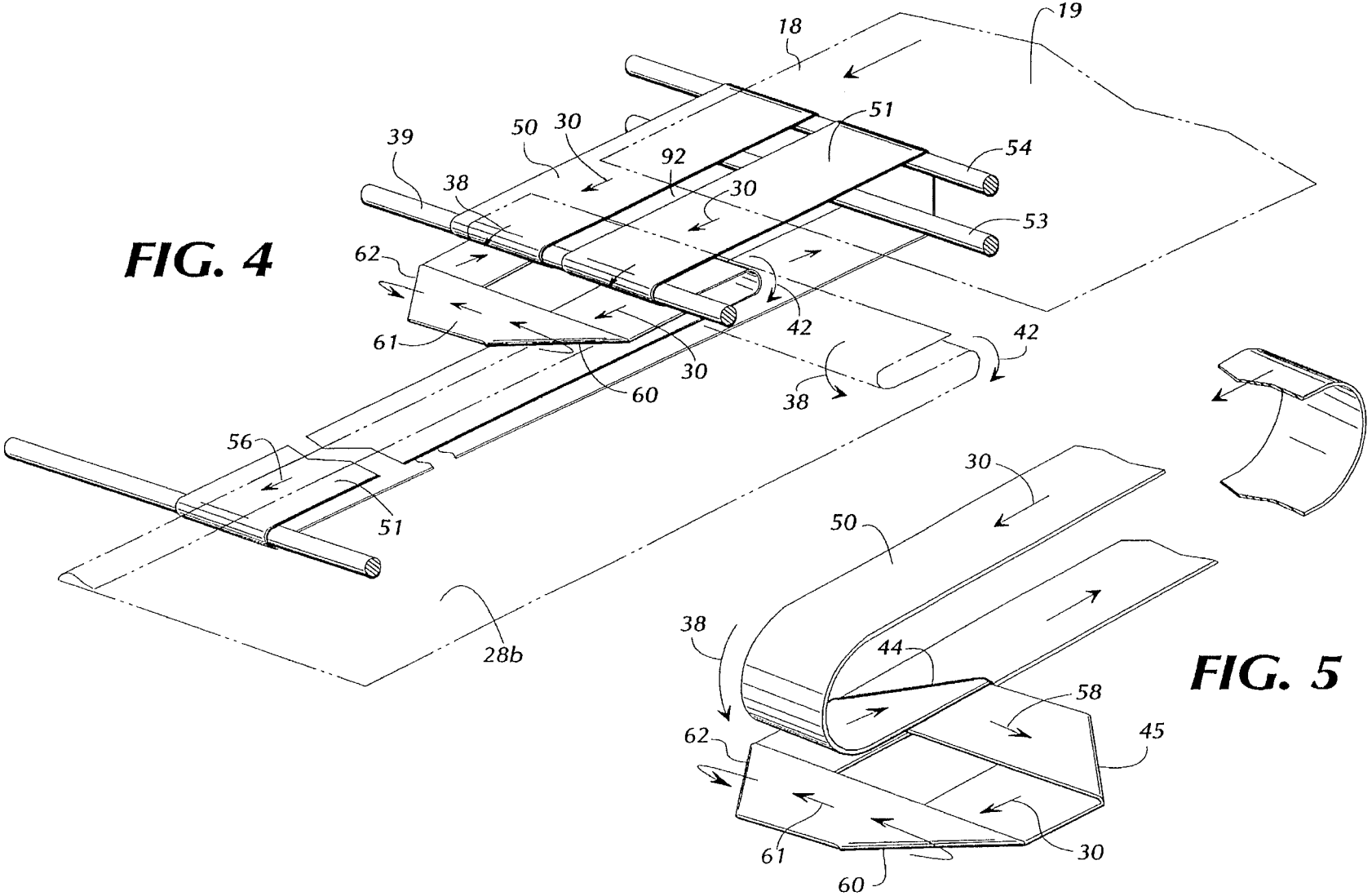
FIG. 4 is a perspective illustration of one side of the system, showing the belt travel of both the turning belt and the body carrying surface conveyor belt, with portions of segments of sheet material shown in dashed lines.
FIG. 5 is a perspective illustration of the turning belt, with parts broken away to reduce the size of the drawing.

FIG. 4 illustrates the surface conveyor belts 50 and 51 that are used to move the side portion of the sheet material through the turns as illustrated in FIG. 3. The belts are initially arranged in side-by-side closely spaced parallel relationship as they move toward the folding station 36.

The segment **28*a* of the sheet material is placed on the conveyor belts 50 and 51, with the edge portion 18 of the segment placed on the turning belt 50 and the adjacent body portion of the segment being placed on the adjacent body carrying surface conveyor belt 51, also known as the body belt 51. The belts 50 and 51 move from their guide rolls 53 and 54 and the segment 28*a* is carried in unison in the forward direction 30** with the belts. At this stage, the sheet segment overlies the belts.

After the belts 50 and 51 move in unison through the first reverse turn 38 about the guide roll 39, the belts overlie the sheet material. In this configuration, the body belt and adjacent body portion 19 of the segment of sheet material advance about the second reverse turn 42. As the body belt 51 advances about the second reverse turn 42 and proceeds on its lower flight 56, the turning belt 50 advances through its first and second right angle turns 44 and 45. When the turning belt 50 emerges from its first right angle turn 44, the sheet material overlies the turning belt and the turning belt advances laterally as indicated by arrow 58 to a position overlying body belt 51. When turning belt reaches the overlying relationship with respect to body belt 51, the turning belt moves through its second right angle turn 45, turning downwardly and into aligned overlying relationship with respect to body belt 51 with the turning belt overlying the edge portion of the segment of sheet material. After the turning belt advances a short distance in the forward direction 30, it is turned upwardly through the third right angle turn 60, to move in a lateral direction 61 off the segment of sheet material and toward underlying relationship with respect to its upper flight. Once the turning belt has become aligned beneath its upper flight, it is turned downwardly through the fourth right angle turn 62 and advanced through its return flight toward guide roll 53.

The turning belt is illustrated in isolation in FIG. 5, without showing the body belt. It should be noted that the first, second and fourth right angle turns are downward turns, whereas only the third right angle turn 60 is an upward turn.

Figures 6, 7:
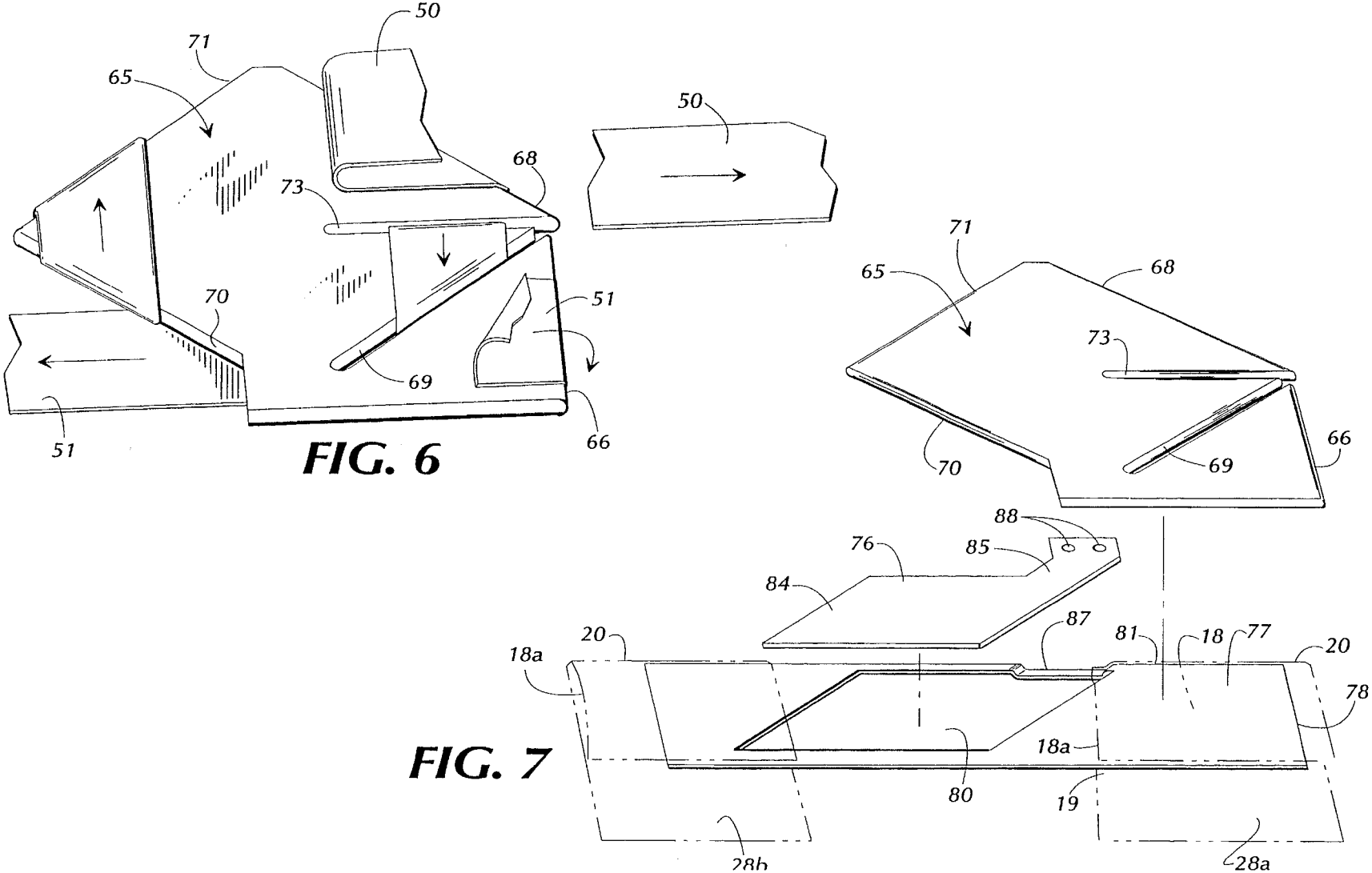
FIG. 6 is a perspective illustration of the turning plate, showing how the turning belt and body carrying surface conveyor belt move about the turning plate.
FIG. 7 is an exploded perspective illustration of the turning plate, folding plate, and separator plate with the edges of trailing and leading sheet segments shown in dashed lines.

FIG. 6 shows the turning plate 65 in the manner in which the belts 50 and 51 move about the turning plate. Turning plate 65 has upper and lower flat surfaces, with only the upper surface being illustrated. The turning plate is formed with a reversing edge 66 which is used to reverse the direction of movement of the body belt 51 through the second U-turn 42, and angled turning edges 68, 69, 70 and 71 which turn the turning belt 50 through its four right angle turns, respectively. Open ended slot 73 extends from the central portion of the turning plate 65 and intersects the corner that would be formed between the first and second turning edges 68 and 69. It will be noted that the turning belt 50 and the edge portion 18 of the sheet material will pass through the open ended slot 73, so both the belt and the edge portion of the sheet material will move from beneath the turning plate to above the turning plate prior to turning about second turning edge 69 through its second right angle turn. This permits the belt and edge portion of the material to turn downwardly about both the first and second turning edges 68 and 69.

FIG. 7 illustrates the turning plate 65, separator plate 76 and fold plate 77 in expanded relationship. Fold plate 77 defines a space 80 and a folding edge 81. Folding edge 81 is substantially rectilinear and is aligned parallel to the forward direction of movement of the segment of sheet material and is positioned so as to form a folding edge against which the fold of the sheet material will be formed. Typically, folding edge 81 will be aligned with the longitudinal space between the belts 50 and 51. However, the position of the fold plate 77 can be adjusted as desired so as to form deeper or shallower hems.

Separator plate 76 has a main body portion 84 that is sized and shaped to be received in the space 80 of the fold plate 77, with a marginal gap surrounding the main body portion 84 sufficient to permit the sheet material to pass through the marginal gap. Support arm 85 extends from body portion 84 of separator plate laterally beyond the folding edge 81 of the fold plate 77. In order to permit the body portion of the separator plate 76 to occupy substantially the same plane as the fold plate 77, a shallow recess 87 is formed in the folding edge 81 of the fold plate which permits the support arm 85 of the separator plate 76 to extend in the same plane as its body portion 84 laterally to a support position, where fasteners extend through the openings 88 to hold the separator plate in position.

Figure 8:
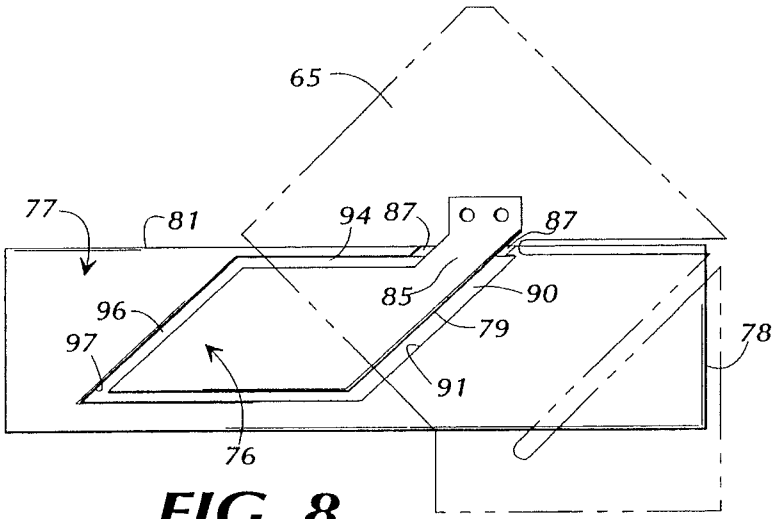
FIG. 8 is a plan view of the folding plate and separator plate, with the turning plate shown in dashed lines.

FIG. 8 shows the relative positions of separator plate 76, fold plate 77 and turning plate 65, with the turning plate shown in dashed lines.

Figure 9:
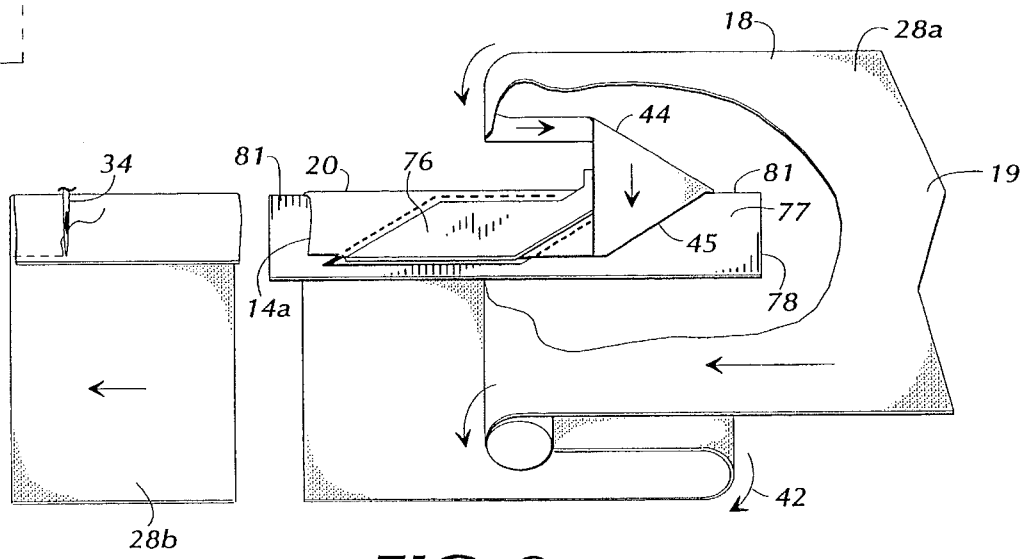
FIG. 9 is a perspective illustration of the fold plate and separator plate as the sheet material moves about these plates.

FIG. 9 illustrates the movements of the edge portion 18 of the segment **28*a* of the sheet material with respect to the fold plate 77 and separator plate 76. When the sheet material advances from the first right angle turn 44, it forms its fold 20 about the folding edge 81 of the separator plate, with the edge portion 18 being laid on top of the fold plate 77 and with the adjacent body portion 19 traveling through the second reverse turn 42 about the back edge 78** of the fold plate, so as to emerge from the second reverse turn beneath the fold plate.

When the edge portion 18 goes through its second right angle turn 45, it is laid on top of the fold plate 77 and begins to move parallel to the folding edge 81. Separator plate 76 has a separating edge 79 (FIG. 8) which is slanted at an angle of approximately a 45° from the arm 85 along the leading separating edge of the body portion in the direction of movement with respect to the oncoming edge portion 18 of the sheet material, but which faces the oncoming sheet material. The pressure from the turning belt 50 urges the edge portion 18 of the sheet material to move down into the marginal gap 90 between the separating edge 79 of the separator plate and its adjacent edge 91 of the fold plate.

It should be noted that the fold 20 of the hem being formed in the sheet material reaches the recess 87 of the folding edge 81 of the fold plate 77 first, before the other portions of the leading edge **18*a* of the folded over edge portion 18 reach the separator plate 76. Thus, with the downward urging of the edge portion 18 by the fold belt, together with the tendency of the fold of the material to follow the downward directed recess formed in the folding edge 81, the fold 20 at the leading edge 18***a* of the edge portion begins to pass beneath the separator plate first, and the slanted edge 79 progressively urges the rest of the leading edge 18*a* beneath the separator plate 76. As the leading edge of the material begins to pass beneath the arm 85 of the separator plate 76, the separator plate progressively covers the leading edge because of the slant of the leading edge 79 with respect to the oncoming direction of movement of the leading edge 18*a* of the segment 28*a*. With this construction, the leading edge 18*a* of the edge portion 18 of the sheet material will always pass beneath the separator plate 76.

Once the leading edge of the hem is moved underneath the separator plate 76, the turning belt 50 is passed through the third right angle turn 60 (FIGS. 4 and 5), so that the turning belt is lifted away from the sheet material and begins to move toward its return flight.

After the turning belt 50 has been separated from and begins to move away from the edge portion 18 of the sheet material, the fold 20 reaches the end of the longitudinal marginal gap 94 (FIGS. 7 and 8) between the separator plate 76 and fold plate 77. Because the material straddles fold plate 77, the edge portion 18 must ride from beneath the separator plate 76 to a covering relationship with respect to the end of the fold plate 77. Again, the slant of the edge 97 of fold plate behind the separator plate progressively urges the leading edge of the hem over the end of the fold plate. The obtuse angle between the longitudinal marginal gap 94 and the trailing angled marginal gap 96 causes the leading edge 18*a* to be progressively lifted out from beneath the separator plate 76, so as to progressively move onto the top side of fold plate 77. This is performed without disrupting the fold 20 in the sheet material.

At this stage, the sheet material has been successfully folded to form the foot and head hems (the process of folding the foot hem is not illustrated but is substantially the same as the disclosed process), and the sheet material moves away from the folding station 32 toward the sewing station 34, where the hem is permanently attached to the main body portion of the sheet material.

In most instances, additional folding and hemming will be performed on the cut edges of the sheet material as they approach the sewing machines 34 and 35, with conventional prior art folding and hemming equipment of the type illustrated in U.S. Pat. No. 3,906,878. Further, a label can be inserted in the hem prior to the sewing function, if desired, with the use of conventional label inserting equipment.

While the foregoing description and accompanying drawings provide a disclosure of the preferred embodiment of the invention, it will be understood by those skilled in the art that variations and modifications thereof can be made without departing from the spirit and scope of the invention as set forth in the following claims.

I claim:

1. A process of automatically and progressively folding a length of flexible sheet material having at least one edge portion and an adjacent body portion by folding the edge portion of the length of flexible sheet material into folded relationship on the adjacent body portion of the sheet material as the sheet material advances generally parallel to the length of the edge portion toward a work station, comprising the steps of:

advancing an edge-carrying surface conveyor belt and a body-carrying surface conveyor belt in side-by-side parallel relationship in a first direction toward the work station, placing the edge portion of the flexible sheet material in parallel overlying relationship on the edge-carrying belt and the adjacent body portion of the sheet material on the body-carrying belt;

advancing the edge portion and adjacent body portion of the material along their lengths in unison with the edge-carrying and body-carrying belts, respectively, toward the work station, turning both the edge-carrying belt and the body-carrying belt and the sheet material through a first reverse turn to advance in a reverse direction generally opposite to the first direction so that the belts overlie the sheet material, turning the body-carrying belt and the adjacent body portion of the sheet material through a second reverse turn to advance parallel to the first direction so that the body portion of the sheet material overlies the body-carrying belt, as the adjacent body portion of the sheet material is moved through the second reverse turn, turning the edge-carrying belt and the edge portion of the sheet material through a first right angle turn to advance over the adjacent body portion of the material, and orient the length of the edge portion of the material at a right angle with respect to the length of the adjacent body portion of the sheet material, with the edge portion of the material overlying the edge-carrying belt, turning the edge-carrying belt and the edge portion of the sheet material through a second right angle turn to orient the length of the edge portion of the sheet material parallel to the length of the adjacent body portion of the sheet material, with the edge-carrying belt overlying the edge portion of the material, turning the edge-carrying belt through a third right angle turn to move the edge-carrying belt away from the sheet material, separating the edge portion of the sheet material and the edge-carrying belt before the edge carrying belt moves through the third right angle turn and as the edge portion of the sheet material is separated from the edge-carrying belt continuing to move the edge portion of the sheet material in parallel overlying relationship with the adjacent body portion of the sheet material toward the work station, turning the edge-carrying belt through a fourth right angle turn to move the edge-carrying belt in the reverse direction opposite to the first direction, and wherein the steps of turning the edge-carrying belt through right angle turns comprises advancing the edge carrying belt about edges of a turning plate which are oriented at forty-five degree angles with respect to the directions of movement of the edge-carrying belt.

2. The process of claim 1 and wherein the step of separating the edge portion of the sheet material and the edge-carrying belt comprises passing the edge portion of the material and the edge carrying belt on opposite sides of a separator plate.

3. The process of claim 1 and wherein between the steps of turning the edge portion of the material through first and second right angle turns further comprises the step of:

advancing the edge portion of the sheet material on one side of a fold forming plate while advancing the adjacent body portion of the material on the other side of the fold forming plate.

4. The process of claim 3 and wherein the step of separating the edge portion of the sheet material and the edge-carrying belt comprises:

passing the edge portion of the material and the edge carrying belt on opposite sides of a separator plate as the edge portion of the sheet material advances along the fold forming plate.

5. The process of claim 1 and prior to the step of placing the edge portion and adjacent body portion of sheet material on the belts, performing the steps of:

paying out sheet material from a supply of sheet material, cutting the sheet material into segments of sheet material, and wherein the step of placing an edge portion of flexible sheet material on the edge-carrying belt comprises placing the cut edge portion of a segment of sheet material on the edge-carrying belt.

6. A process of automatically and progressively folding a length of flexible sheet material having at least one edge portion and an adjacent body portion by folding the edge portion of the segment into folded relationship with the adjacent body portion of the segment, comprising the steps of:

advancing the edge portion and adjacent body portion of the segment parallel to their lengths in a first direction along a path toward a processing station, turning the edge portion and adjacent body portion of the segment through a first reverse turn to advance in a reverse direction generally opposite to the first direction, turning the adjacent body portion through a second reverse turn about an edge portion of a turning plate to advance parallel to the first direction, as the adjacent body portion is turned through the second reverse turn, turning the edge portion of the segment through a first right angle turn about a forty-five degree angled edge portion of the turning plate to advance the edge portion of the segment from a first side to a second side of the turning plate inwardly toward overlying relationship on the adjacent body portion of the segment, moving the edge portion of the segment through a slot of the turning plate from the second side to the first side of the turning plate as the edge portion advances inwardly toward overlying relationship on the adjacent body portion of the segment, and after the edge portion of the segment has moved through the slot of the turning plate turning the edge portion of the segment through a second right angle turn about a forty-five degree angled edge portion of the turning plate to advance the edge portion of the segment from the first side to the second side of the turning plate into parallel overlying folded relationship with the adjacent body portion of the segment.

7. The process of claim 6 and wherein the adjacent body portion of the segment of sheet material moves on a first side of the turning plate after the adjacent body portion is turned through the second reverse turn, and wherein the edge portion of the segment moves on the first side of the turning plate after the edge portion is turned through the first and second right angle turns, and about the second side of the turning plate after the edge portion is moved through the slot of the turning plate.

8. The process of claim 6 and prior to turning the edge portion and adjacent body portion of the segment through a first reverse turn, paying out sheet material from a supply, and cutting segments from the sheet material, and wherein the step of advancing the edge portion and adjacent body portion along a path toward a processing station comprises advancing the segment parallel to its cut edge along the path.

9. The process of claim 8 and further including the step of advancing the folded segment of sheet material to a sewing machine and forming stitches through the folded portion of the segment with the sewing machine.

10. A separator and alignment apparatus for a sheet hemming system for separating a conveyor belt from an open hem of moving sheet material, said apparatus comprising:

a folding plate having a folding edge for aligning with the direction of movement of the sheet material and about which the hem is folded for establishing the fold of the hem, said folding plate defining a space therein, and a separator plate having a body portion positioned in the space of said folding plate, said separator plate including an arm means which extends from said body portion across the folding edge of said folding plate, and said separator plate and arm means including a separator edge for facing the oncoming hem of the sheet material at an angle slanted from said arm in the direction of movement of the sheet material.

11. A turning plate for progressively turning an edge portion onto an adjacent body portion of a length of flexible sheet material moving generally parallel to the length of the edge portion through a processing path about the turning plate, comprising:

a reversing edge formed on said turning plate adapted to extend normal to the oncoming adjacent body portion of the sheet material for turning the adjacent body portion of the sheet material about the turning plate through a reverse turn, a first angled turning edge formed on said turning plate extending at forty-five degrees with respect to said reversing edge and adapted to turn the oncoming edge portion of the sheet material about the turning plate through a first right angle turn to move toward the adjacent body portion of the sheet material as the adjacent body portion of the segment moves through the reverse turn, a second angled turning edge formed on said turning plate extending at a right angle with respect to said first angled turning edge and adapted to turn the oncoming edge portion of the sheet material about the turning plate through a second right angle turn into folded relationship with the adjacent body portion of the sheet material, and an open ended slot between said first and second angled turning edges adapted to pass the edge portion of the sheet material from one side to the other side of the turning plate.

12. The turning plate of claim 11 and wherein said turning plate further includes third and fourth angled turning edges extending parallel to said first and second angled turning edges respectively for reversing the direction of movement of a belt carrier moved about said first and second turning edges.

13. An edge folding assembly for automatically and progressively turning an edge portion of a length of flexible sheet material into folded relationship on the adjacent body portion of the sheet material as the sheet material advances generally parallel to the length of the edge portion toward a work station, comprising:

a turning means having first and second angled turning edges for turning the edge portion of the sheet material over into parallel folded relationship on the adjacent body portion of the sheet material, a fold plate means having a folding edge oriented parallel to the path of movement of the edge portion of the sheet material as the edge portion of the sheet material advances from said second angled turning edge of said turning means, said fold plate means adapted to be positioned between the edge portion and the adjacent body portion of the sheet material for forming a fold in the sheet material between the edge portion and the adjacent body portion thereof, a separator plate means having a separating edge oriented across the path of movement of the edge portion of the sheet material as the edge portion of the sheet material advances from said second angled turning edge of said turning means, said separator plate means adapted to separate the edge portion of the sheet material from said turning means.

14. The edge folding assembly of claim 13 and wherein said fold plate means defines a space, and wherein said separator plate means is sized and shaped to fit within the space of said fold plate means.

15. A separator and alignment apparatus for a sheet hemming system for separating a conveyor belt from an open hem of moving sheet material, said apparatus comprising:

a folding plate having a folding edge for aligning with the direction of movement of the sheet material and about which the hem is folded for establishing the fold of the hem, said folding plate defining an open space therein displaced laterally from said folding edge, and a separator plate having a body portion positioned in the open space of said folding plate, said body portion of said separator plate being of smaller breadth than said open space so as to define with the folding plate marginal gaps which surround said separator plate, said separator plate including an arm which extends from said body portion across said folding plate, said folding plate defining at its folding edge a recess which receives the arm of said separator plate.

16. The separator and alignment apparatus of claim 15 and wherein the body portion of said separator plate includes a separator edge that is adapted to face the path of the oncoming hem of the sheet material at an angle slanted from said arm in the direction of movement of the sheet material.

17. The separator and alignment apparatus of claim 16 and wherein said slanted separator edge extends along said arm across the recess of said folding plate.

18. The separator and alignment apparatus of claim 17 and wherein said slanted separator edge extends at an angle of approximately 45° with respect to the path of the oncoming sheet material.

* * * * *